US005394653A

United States Patent [19]

Maier

[11] Patent Number: 5,394,653

[45] Date of Patent: Mar. 7, 1995

[54] GRINDER FOR GRINDING A CYLINDRICAL OR SPHERICAL SURFACE OF A ROLL, ESPECIALLY A PAPER MACHINE ROLL

[75] Inventor: Urs Maier, Winterthur, Switzerland

[73] Assignee: Farros Blatter AG, Switzerland

[21] Appl. No.: 30,439

[22] PCT Filed: Jun. 30, 1992

[86] PCT No.: PCT/CH92/00131

§ 371 Date: Mar. 25, 1993

§ 102(e) Date: Mar. 25, 1993

[87] PCT Pub. No.: WO93/02834

PCT Pub. Date: Feb. 18, 1993

[30] Foreign Application Priority Data

Jul. 31, 1991 [CH] Switzerland ..... 2295/91

[51] Int. Cl.[6] ..... B24B 21/00

[52] U.S. Cl. ..... 451/303; 451/304; 451/307

[58] Field of Search ..... 51/141, 145 R, 148, 51/135 BT, 137, 289 R, 241 S, 251, 252, 142

[56] References Cited

U.S. PATENT DOCUMENTS

| | | | |
|---|---|---|---|
| 2,579,391 | 12/1951 | Minarik et al. | 51/251 |
| 4,575,972 | 3/1986 | Ohki et al. | 51/135 R |
| 4,841,683 | 6/1989 | Williams | 51/252 |
| 5,185,961 | 2/1993 | Maier | 51/148 |

FOREIGN PATENT DOCUMENTS

| | | |
|---|---|---|
| 0359304 | 8/1989 | European Pat. Off. . |
| 1574926 | 9/1980 | United Kingdom . |

*Primary Examiner*—Maurina T. Rachuba

[57] ABSTRACT

The grinder has a frame (6) movable on rollers (8) on which is fitted a grinding device (18) drivable by a motor (84). In order to simplify the grinder and its application to a roll (4) to be treated, the rollers (8) are designed to lower the frame (6) on a scraper (10) or on a rail (56) of a scraper device (2) associated with the roll (4), which rail replaces the scraper (10). The frame (6) has a supporting roller (14) fitted on an adjustable holder (12) which is laterally supported on a bearer (16) for the scraper (10).

11 Claims, 4 Drawing Sheets

GRINDER FOR GRINDING A CYLINDRICAL OR SPHERICAL SURFACE OF A ROLL, ESPECIALLY A PAPER MACHINE ROLL

FIELD OF THE INVENTION

The invention concerns a grinder for grinding a cylindrical or spherical surface of a roll, especially the roll of a paper machine, the roll being one having a scraper device associated with it.

BACKGROUND OF THE INVENTION

A grinder of the above-mentioned kind is for example known from CH-PS 668 212. This device is relatively complicated and accordingly its provision very expensive, since a special carrier as well as an adjustable copying pattern corresponding to the desired shape of the surface to be worked, and which forms a guide path, are required.

The object of the invention is to provide a grinder of the above-mentioned kind adapted to be brought into temporary association with a roll when needed for refinishing the surface of the roll, and which has a simple construction and is easy to use.

SUMMARY OF THE INVENTION

The invention resides in that the grinder uses the scraper apparatus associated with a roll as a carrier and, if need be, as a copying pattern. The additional provision of a carrier and, as the case may be, a copying pattern is therefore unnecessary. The grinder is accordingly simple and inexpensive to make and can moreover be quickly and simply put into place. These advantages especially arise if a damaged roll must be refinished.

The rapid and simple provision capabilities of the grinder thereby also reduces the downtime of a production line. The invention further resides in the grinder being one including a belt grinding mechanism with a contact roll over which the belt passes with the contact roll being floatingly supported so as to be able to suit the contour of the outer surface of the roll so that, for example, cambered rolls can also be ground; and in an alignment apparatus which prevents a tilted application of the grinding member to the roll and thereby avoids fault constituting grinding marks. The invention also resides in further details of the grinder described in the following description and claims.

BRIEF DESCRIPTION OF THE DRAWINGS

Embodiments of the subject matter of the invention are described in more detail hereinafter in connection with schematic drawings which show.

DESCRIPTION OF THE PREFERRED EMBODIMENTS

Figure 1:
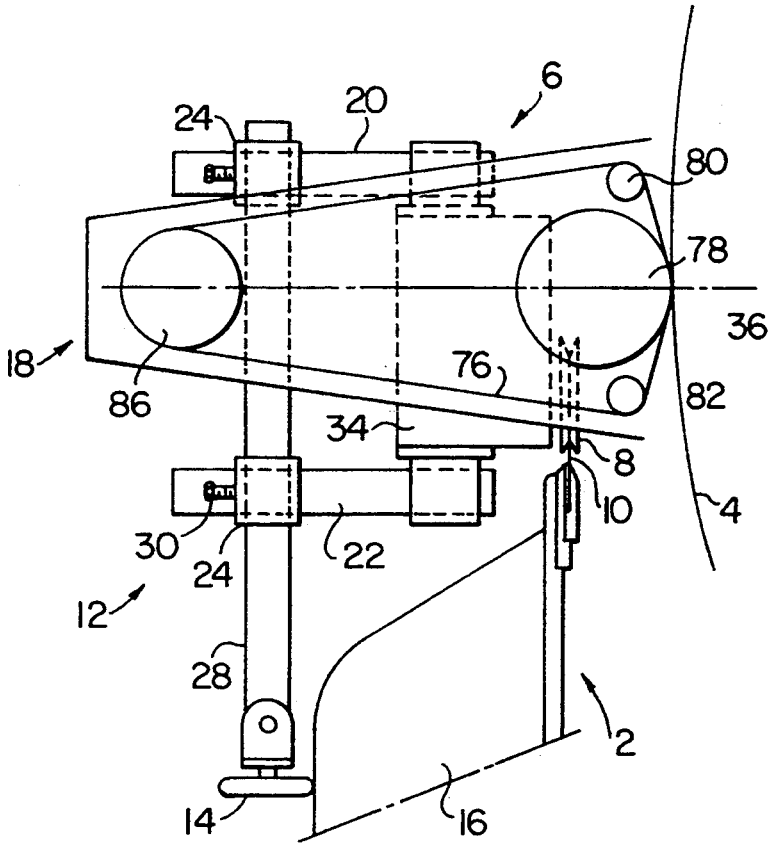
FIG. 1 is a side view, in the direction of sliding movement, of a belt grinder applied to a roll.
Figure 2:
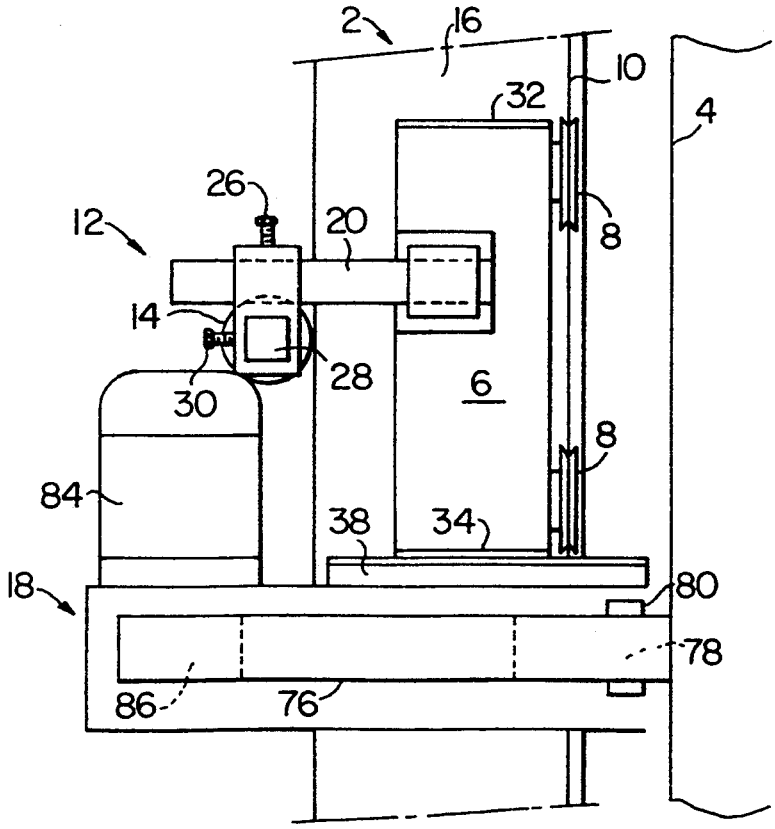
FIG. 2 is a top view of the belt grinder of FIG. 1.

FIGS. 1 and 2 are complete views of a grinder embodying the invention and which grinder is adapted to be temporarily mounted on the scraper apparatus 2 associated with a roll 4, for example the roll of a paper machine, for the purpose of grinding the surface of the roll to improve its condition. The grinder includes a frame 6 with rollers 8 which is placed on a scraper blade 10 of the scraping apparatus 2, the scraping apparatus 2 being shown in the condition of being pivoted away from the roll 4. A frame 6 includes a holder 12 with an engagement roller 14, which laterally engages the carrier 16 of the scraping apparatus 2. A grinder mechanism 18, in the form of a belt grinder mechanism, is fastened to the frame 6.

The holder 12 has an upper arm 20 and a lower arm 22 which are fastened to the frame 6 and extend transversely to the plane of the rollers 8. Each arm 20, 22 is provided with a double clamping member 24 which itself is fixed to the associated arm 20, 22 by means of a clamping screw 26. A rod 28 is fixed to the clamping members so as to extend transversely to the arms and likewise is fixed by clamping screws 30. The engagement roller 14 is supported on the lower end of the rod with the plane of the roller 14 running perpendicular to the plane of the rollers 8. With the help of the clamping members 24 the rod 28 can be adjusted as to its position on the arms 20, 22 as well as to its height. The arrangement of the holder 12 is such that the rod 28 is located along the length of the frame 6 halfway between the rollers 8. Thereby a three point support is achieved which is especially stable. Moreover this support makes it possible that the grinder mechanism 18 can be exchangably fastened at the cheeks 32, 34 of the frame 6. For this the grinder mechanism 18 is made so as to be essentially mirror image symmetrical with respect to the horizontal plane 36, so that through use of the mounting plate 38 forming part of the grinder mechanism the grinder mechanism can be selectively attached to either one of the two cheeks 32, 34.

Figure 3:
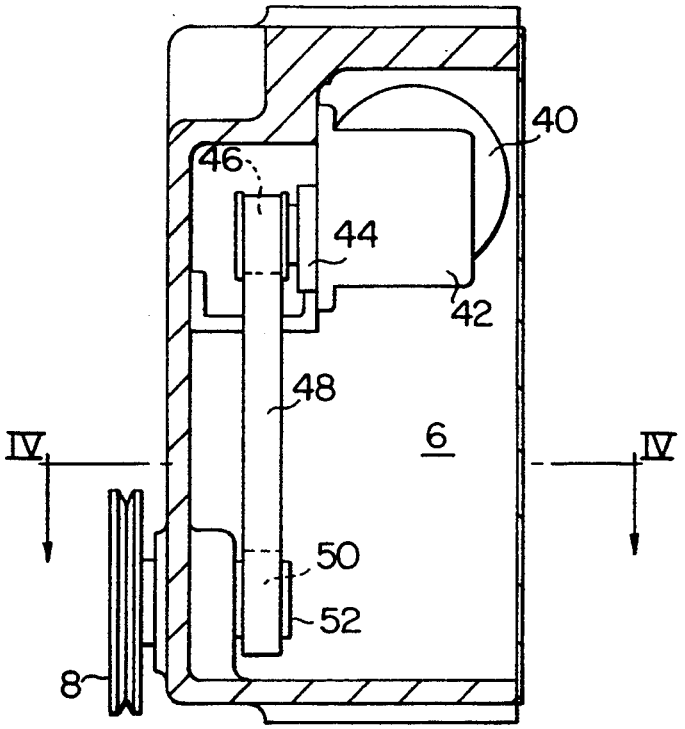
FIG. 3 is a sectional view of the frame of the belt grinder taken along the line III—III of FIG. 4.
Figure 4:
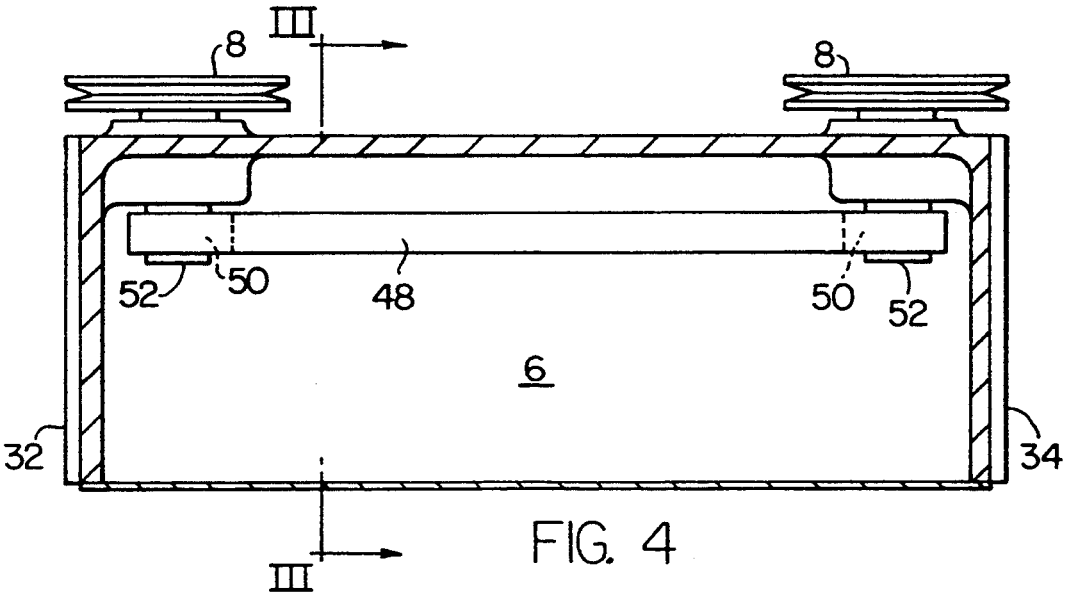
FIG. 4 is a sectional view of the frame of the belt grinder taken along the line IV—IV of FIG. 3.

FIGS. 3 and 4 show details of the drive of the rollers 8 of the frame 6. As to this, the frame contains a drive motor 40 which through a drive 42 and a clutch 44 drives a drive wheel 46 for a toothed belt 48. The belt 48 is trained over two wheels 50, fastened to shafts 52, on which the rollers 8 are arranged.

Figure 5:
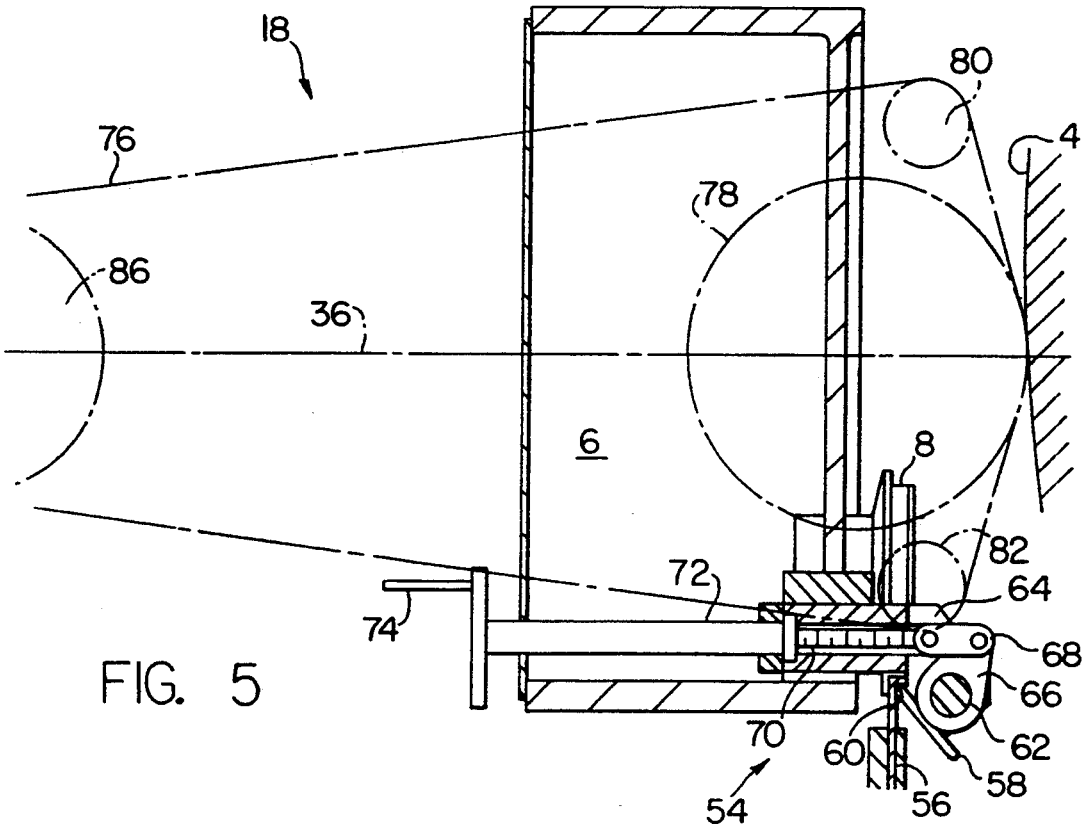
FIG. 5 is a sectional view of the frame of the belt grinder with a supplemental securing apparatus taken along the line V—V of FIG. 6.
Figure 6:
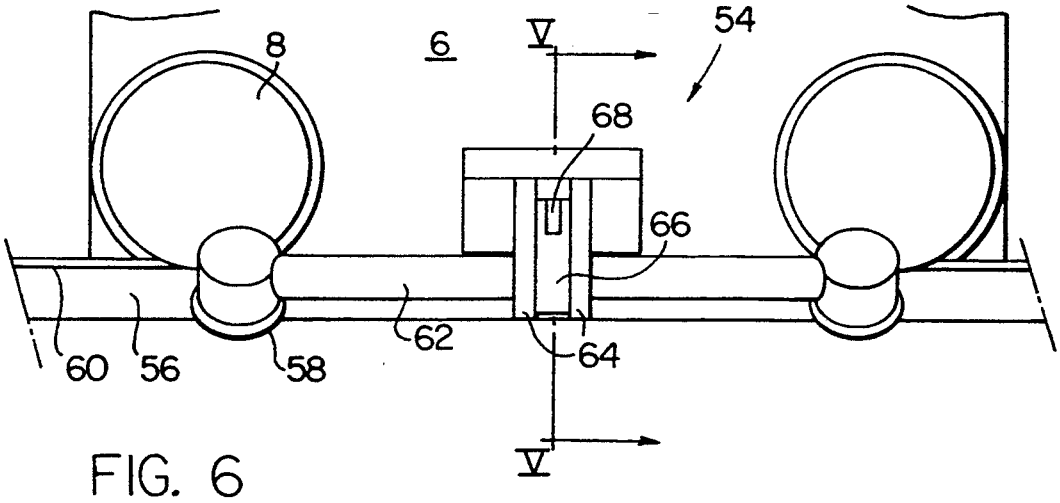
FIG. 6 is a right side view of the securing apparatus of FIG. 5.

FIGS. 5 and 6 show a supplementary securing mechanism 54 for securing the grinder to the scraper apparatus 2. In this case the scraper 10 of the scraper apparatus 2 is first replaced in the scraper apparatus 2 by an L shaped rail 56. The rollers 8 run on the rail 56. The securing mechanism 54 includes securing rollers 58 which are associated with the rollers 8 and which are pivotal into engagement with the inner side 60 of the L shaped rail 56. For this the securing rollers 58 are fastened to a pivot axle 62 which in turn is pivotably supported in arms 64 on the frame 6. To the pivot axle 62 is fastened a lever 66 which is connected through a coupling member 68 with a threaded spindle 70. The spindle 70 cooperates with a rotatably supported sleeve 72 having a non-illustrated internal thread. The sleeve 72, which is rotatably supported in the frame 6, is provided with a hand crank 74. By rotation of the hand crank 74 the securing rollers 58 can be moved into and out of engagement with the inner side 60 of the L shaped rail 56 as well as be pressed against it.

Figure 7:
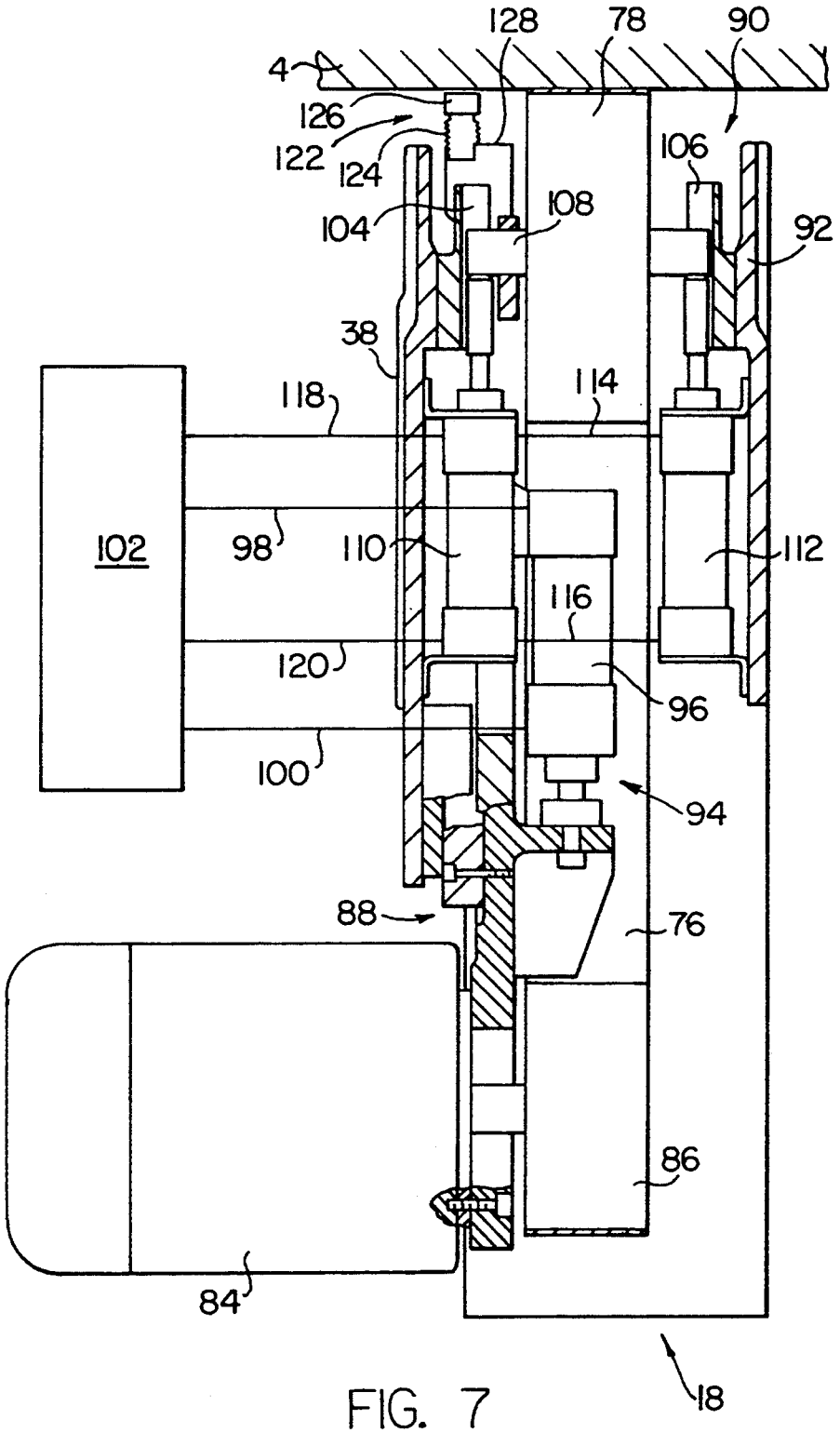
FIG. 7 is a horizontal sectional view of the belt grinder of FIG. 1.

FIGS. 1, 2 and 7 show the grinding mechanism, formed as a belt grinding mechanism 18, in detail. The grinding belt 76 is guided over a floatingly supported contact roll 78, over fixedly positioned guide rolls 80, 82 adjacent both sides of the contact roll, and over a drive roll 86 driven by a drive motor 84. The drive motor 84 is arranged on a slide 88 which is arranged in a housing 92 containing the floating support 90 for the contact roll 78. A belt tensioning device 94 serves to tension the grinding belt, which device cooperates with the slide 88 of the drive motor 84 and biases the drive roll 86 away from the contact roll 78. The belt tensioning device 94 includes a piston/cylinder unit 96 connected by conductors 98, 100 with a fluid mechanism 102. The floating support 90 for the contact roll 78 includes longitudinal guides 104, 106 contained in the housing 92 for the axle 108 on which the contact roll 78 is rotatably supported. The longitudinal guides 104, 106 extend perpendicularly to the surface to be worked, that is radially to the work roll 4. The axle 108 in the longitudinal guides 104, 106 is yieldingly engaged with piston/cylinder units 110, 112. In connection with this, the corresponding pressure spaces of the piston/cylinder units 110, 112 are connected with one another by Connecting conductors 114, 116. The piston/cylinder units 110, 112 are moreover connected by conductors 118, 120 to the fluid apparatus 102. The piston/cylinder units 110, 112 also serve at the same time for positioning the contact roll against the work surface, that is the work roll 4. An alignment device 122 serves for aligning the contact roll in the delivery and application of the contact roll 78 to the work surface in order to avoid a one-sided contact and therewith a one-sided grinding of the roll 4. The alignment device 22 includes threaded shafts 124 on both sides of the contact roll 78, of which only one shaft is illustrated, with a rigidly locked contact surface 26, which is displaced rearwardly a few tenth millimeters from the working position of the grinding belt. Each threaded shaft 124 is fastened to a protective cover 128 for the floating support 90, which cover itself is connected with the axle 108 of the contact roll 78. If the contact roll 78 is unequally delivered, one of the two threaded shafts 124 come to rest on the roll 4 and brings the contact roll into essentially aligned position with the roll.

The control for the grinding mechanism through the fluid apparatus 102, which is preferably an air pressure apparatus, takes place in a way, not more specifically illustrated, such that first through the piston/cylinder unit 96 the grinding belt 76 has imparted to it a given tension force. In connection with this the contact roll 78 through the axle 108 engages the associated piston/cylinder units 110, 112 in which the necessary counterpressure is built up. If the contact roll 78 is pushed forwardly against the work surface, that is against the roll 4, with the help of the piston/cylinder units 110, 112, the piston/cylinder unit 96 is retracted to the same measure, so that the once adjusted belt tension remains constant. Upon grinding the guide rolls 80, 82 serve for the stabilization of the grinding belt on the contact roll 78, especially when because of the contour of the work surface the contact roll 78 because of the floating support 90 takes on an angular position deviating from its base position. Because of the floating support 90 the contact roll 78 can follow the contour of a surface to be ground. Thereby it is possible, without special measures to re-grind an existing surface especially to improve it. The fluid apparatus 12 provides that during straight line guiding of the belt grinding mechanism, the pressure at which the contact roll is applied to the work surface, and which contact roll may for example be following a cambered contour of the work surface, is always held constant.

I claim:

1. A grinder for grinding a cylindrical or spherical surface of a roll, such as a paper machine roll, which roll has associated with it a scraper apparatus including a scraper blade and a scraper blade carrier carrying said blade, said grinder comprising a frame (6) movable on rollers (8), on which frame is arranged a grinding mechanism (18) drivable by means of a motor (84), said rollers (8) being adapted for placement onto said scraper blade (10) or onto a rail (56) temporarily replacing said scraper blade (10) on said scraper blade carrier (16), said frame (6) having an engagement roller (14) arranged on an adjustable holder (12) for laterally engaging said scraper blade carrier (16), said grinding mechanism including a grinding belt (76), a floatingly supported contact roll (78), and guide rolls (80, 82) arranged on both sides of said contact roll for guiding said grinding belt (76) onto and off of said contact roll, and an alignment apparatus (122) for aligning said grinding belt relative to the roll (4) during its delivery to the roll (4).

2. A grinder according to claim 1 characterized in that the holder (12) includes at least one arm (20, 22) arranged on the frame (6) which arm is directed perpendicularly to the plane of the rollers (8), with a rod (28) arranged on this arm (20, 22) by means of a double clamping member (24), which rod runs perpendicular to the arm (20, 22) and at its lower end carries the engagement roller (14) whose plane runs essentially perpendicularly to the plane of the rollers (8).

3. A grinder according to claim 1 characterized in that the engagement roller (14) is arranged tat half the length of the frame (6).

4. A grinder according to claim 1 characterized in that at least one roller (8) is drivable by means of a motor (40) with the connection between the motor (40) and the roller (8) preferably being makable and breakable by means of a clutch (44).

5. A grinder according to claim 1 further characterized in that said rollers (8) are adapted for placement on a rail (56) having an L shape in cross section which rail is exchangeable with said scraper blade (10) of the scraper apparatus (2) associated with the roll (4), said rollers (8) having associated with them security rollers (58) which are pivotal into engagement with the inner side (60) of the L-shaped rail (56).

6. A grinder according to claim 1 characterized in that the frame (6) and the grinding mechanism (18) are formed to permit two sided exchangeable coupling of one to the other.

7. A grinder according to claim 1 characterized in that the axle (108) of the contact roll (78) is supported in longitudinal guides (104, 106), which guides are arranged perpendicular to the work roll (4), with the axle (108) preferably being yieldingly supported on both sides of the contact roll (78).

8. A grinder according to claim 7 characterized in that the axle (108) of the contact roll (78) is engaged on both sides by piston/cylinder units (110, 112) whose corresponding pressure spaces are connected with one another by a conductor (114, 116).

9. A grinder according to claim 8 characterized in that the piston/cylinder units (110, 112) are connected with a fluid apparatus (102) and are adapted for the delivery of the contact roll (78) to the roll (4) to be worked.

10. A grinder according to one of claim 1 characterized in that the belt grinding mechanism (18) includes a drive motor (84) with a drive roll (86) for the grinding belt (76) arranged on a slidably supported slide (88), with the drive motor (84) being connected with a belt tensioning device (94).

11. A grinder according to claim 1 characterized in that the belt tensioning device (94) includes a piston/-cylinder unit (96) cooperating with the slide (88) of the drive motor (84), which unit (96) cooperates with the piston/cylinder units (110, 112) of the contact roll (78) through the fluid apparatus (102) so that the belt tension force essentially remains constant during the delivery of the contact roll (78) and/or the working.

* * * * *